United States Patent [19]

Gergonne

[11] 4,178,658

[45] Dec. 18, 1979

[54] DOOR STOP WITH REMOVABLE DAMPING MEMBER

[75] Inventor: Pierre Gergonne, Oyannax, France

[73] Assignee: Etablissements Gergonne, Oyannax, France

[21] Appl. No.: 919,493

[22] Filed: Jun. 27, 1978

[30] Foreign Application Priority Data

Jun. 29, 1977 [FR] France ..... 77 19995

[51] Int. Cl.[2] ..... E05F 5/02

[52] U.S. Cl. ..... 16/86 A

[58] Field of Search ..... 16/82, 83, 86 R, 86 A; 292/341.12, DIG. 8, DIG. 9, 343, 342, DIG. 15

[56] References Cited

U.S. PATENT DOCUMENTS

| | | | |
|---|---|---|---|
| 1,884,505 | 10/1932 | Atwood | 16/86 R |
| 1,886,934 | 11/1932 | Atwood | 16/86 R |
| 2,596,780 | 5/1952 | Meyers et al. | 16/86 A |
| 2,819,921 | 1/1958 | Solari | 16/86 A X |
| 3,140,517 | 7/1964 | Richter | 16/86 R X |
| 3,913,171 | 10/1975 | Reid | 16/82 |
| 3,994,043 | 11/1976 | Gurzenda | 16/86 A |

FOREIGN PATENT DOCUMENTS

| | | | |
|---|---|---|---|
| 2437052 | 2/1976 | Fed. Rep. of Germany | 16/86 R |
| 304725 | 12/1929 | United Kingdom | 16/83 |

*Primary Examiner*—Werner H. Schroeder
*Assistant Examiner*—Moshe I. Cohen
*Attorney, Agent, or Firm*—Lawrence E. Laubscher

[57] ABSTRACT

A door stop is disclosed including a rigid body member a stop which is not a significant obstacle to the feet of persons passing member is removably connected with the body member. The body member includes a planar horizontal bottom wall, a pair of generally parallel vertical side walls, and a vertical partition extending between and normal to the side walls spaced from one end edge of the bottom wall to define a recess for receiving the damping member. A cover member is removably connected with the body member and retains the damping member within the body member recess. In a preferred embodiment, the resilient damping member includes a groove and the partition includes a tongue portion which cooperates with the groove to removably connect the damping member with the door stop body member.

7 Claims, 3 Drawing Figures

DOOR STOP WITH REMOVABLE DAMPING MEMBER

BACKGROUND OF THE INVENTION

Door stops are generally well known in the art comprising a rigid cylindrical support member surrounded by a cylindrical or annular rubber cushion. An axially arranged screw or nail passes through the cushion and support to secure the door stop to a floor in a position to prevent a door from striking a wall.

While the prior door stops normally operate quite satisfactorily, they do possess the inherent drawback that when it becomes necessary to replace the cushion, the screw or nail used to secure the stop to the floor must be removed. Furthermore, the prior door stops provide an inconvenient obstacle to the feet of persons using the door or passing in close proximity to the door.

The present invention was developed to overcome the above and other drawbacks of prior door stops by providing a stop in which the resilient cushion may be quickly and easily replaced without removing the stop from the floor and further by providing a stop which is not an obstacle to the feet of persons passing nearby.

SUMMARY OF THE INVENTION

The primary object of the present invention is to provide a door stop including a body member having a planar horizontal bottom wall, a pair of generally parallel vertical side walls, and a vertical partition extending between and normal to the side walls spaced from one end edge of the bottom wall to define a recess, and a resilient damping member extending within said recess and being removably connected with the body member. A cover member is removably connected with the body member for retaining the resilient damping member within the body member recess.

It is a more particular object to provide a door stop wherein the resilient damping member and the body member are removably connected by a cooperating tongue portion and groove.

According to a further object, the door stop cover member is connected in wedging relation with the body member to retain the damping member within the body member recess, and the cover member is angularly arranged with respect to the body member bottom wall to minimize the obstacle to the feet of persons passing nearby.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
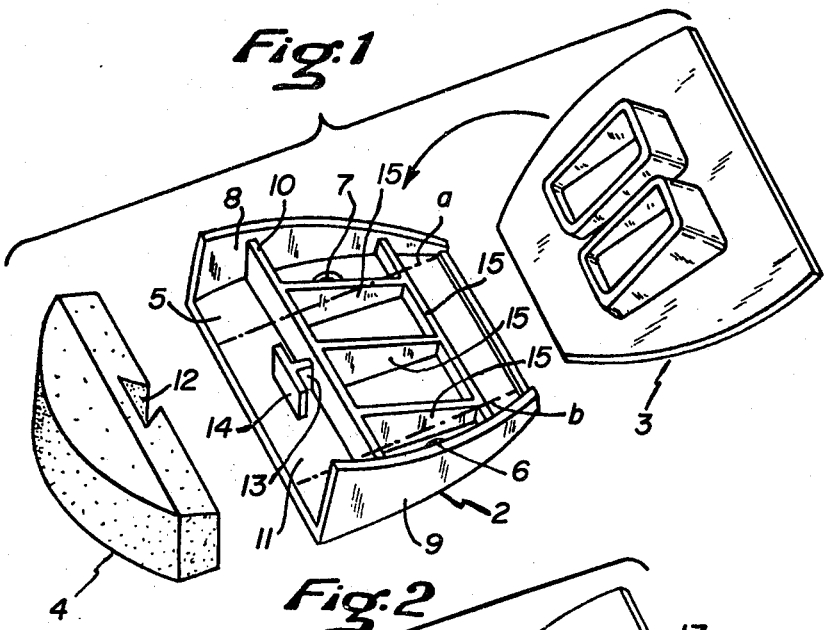
FIG. 1 is a perspective view of the door stop having body, damping, and cover members.
Figure 3:
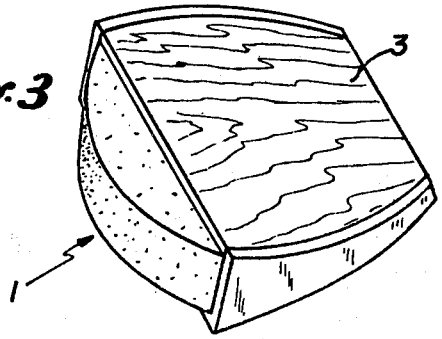
FIG. 3 is a perspective view of the door stop with the cover member connected with the body member.

Referring first to FIGS. 1 and 3, the door stop 1 includes rigid body 2 and cover 3 members and a resilient damping member 4. The rigid body 2 and cover 3 members are formed of a suitable hard synthetic plastics material such as polyethylene, and the resilient damping member 4 is formed of a suitable deformable synthetic plastic material such as polyurethane foam.

As shown more particularly in FIG. 1, the door stop body member 2 has a planar horizontal bottom wall 5 which is to be secured to a floor, carpet, or the like. An adhesive may be applied to the under surface of the bottom wall 5 to adhesively secure the stop to a floor. In the alternative, the bottom wall 5 may contain apertures 6, 7 through which nails, screws or the like may pass in order to fasten the stop to a horizontal surface. The body member further includes a pair of generally parallel vertical side walls 8, 9 and a vertical partition 10 extending between and normal to the side walls, and spaced from one end edge of the bottom wall 5 to define a recess 11.

Figure 2:
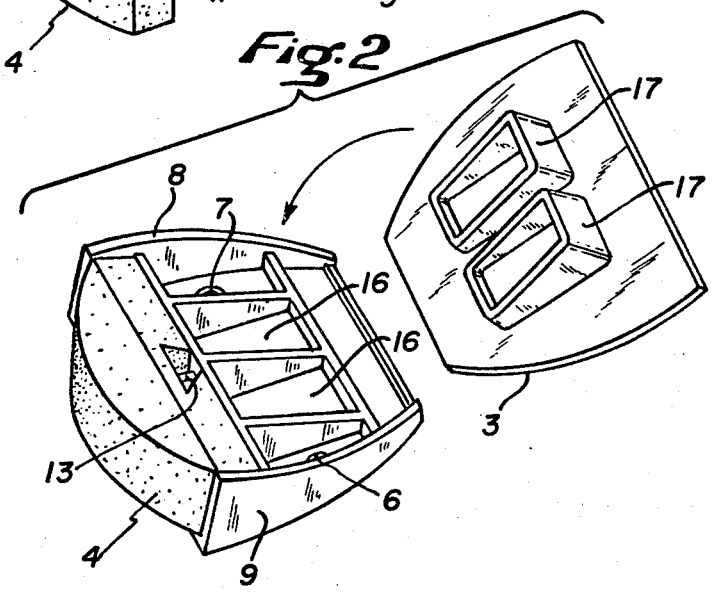
FIG. 2 is a perspective view of the door stop with the damping member connected with the body member.

The damping member 4 extends within the body member recess 11 in contiguous relation with the partition 10 as shown in FIG. 2 and is removably connected with the body member 2. Referring again to FIG. 1, the damping member 4 includes a groove 12 and the body member partition 10 includes a tab 13 and plate 14 which define a tongue cooperating with the groove 11 to removably connect the damping member with the body member.

The body member 2 includes additional partitions 15 which increase the overall rigidity of the door stop and which also cooperate with the partition 10 to define additional recesses 16 as shown in FIG. 2. The lower surface of the cover member 3 includes projections 17 which are dimensioned to fit in wedging relation within the recesses 16 to removably connect the cover member with the body member. When the cover member 3 is connected in wedging relation with the body member 2, the damping member 4 is retained within the body member recess 11 as depicted in FIG. 3.

The upper edges of the pair of side walls 8, 9 are tapered downwardly away from the recess 11 as shown in FIGS. 1 and 2. When the cover member 3 is connected with the body member 2 (FIG. 3) the cover is angularly arranged with respect to a horizontal surface to minimize the obstruction on the surface to the feet of persons passing in close proximity to the door stop.

In operation, the body member 2 is secured to a horizontal surface such as a floor, the damping member 4 is placed in the recess 11 and connected with the body member via the cooperating tongue and groove, and the cover member 3 is connected in wedging relation with the body member 2. Owing to the resiliency of the damping member 4 and the reinforcement of the rigid body member partition 10, when a swinging door comes into contact with the door stop, the damping member will deform slightly while arresting the swinging movement of the door.

While in accordance with the provisions of the Patent Statutes, the preferred form and embodiment of the invention has been illustrated and described, it will be apparent to those skilled in the art that other changes and modifications may be made without deviating from the inventive concepts set forth above.

What is claimed is:

1. A door stop, comprising (a) a rigid body member including a planar horizontal bottom wall, a pair of generally parallel vertical side walls, and a vertical partition extending between and normal to said side walls, said partition being spaced from one end edge of said bottom wall, thereby to define a recess adjacent one end of said body member;

(b) resilient damping means extending within said recess in contiguous relation with said partition;

(c) connecting means removably connecting said damping means with said body member; and (d) a cover member removably connected with said body member for retaining said damping means within said body member recess.

2. A door stop as defined in claim 1, wherein said connecting means comprises (1) a tongue portion arranged on said body member partition; and (2) a groove contained in said damping means, said tongue and groove portions cooperating to removably connect said damping means with said body member.

3. A door stop as defined in claim 2, wherein said damping means comprises a molded synthetic plastic material.

4. A door stop as defined in claim 1, wherein the upper edges of said side walls as tapered downwardly away from said recess, said cover member being angularly arranged with respect to said horizontal bottom wall.

5. A door stop as defined in claim 1, and further including means for removably connecting said cover member with said body member comprising downwardly extending projections on said cover member cooperating in wedging relation with corresponding recesses in said body member to removably connect said cover member with said body member.

6. A door stop as defined in claim 1, wherein said body member bottom wall includes a layer of adhesive arranged on the under surface thereof for securing said body member to a floor.

7. A door stop as defined in claim 1, wherein said body member bottom wall contains at least one aperture for receiving fastening means for securing said body member to a floor.

* * * * *